US007682263B2

(12) United States Patent
Yamamoto

(10) Patent No.: US 7,682,263 B2
(45) Date of Patent: Mar. 23, 2010

(54) GOLF CLUB HEAD

(75) Inventor: Akio Yamamoto, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 27 days.

(21) Appl. No.: 11/979,603

(22) Filed: Nov. 6, 2007

(65) Prior Publication Data

US 2008/0161127 A1 Jul. 3, 2008

(30) Foreign Application Priority Data

Dec. 27, 2006 (JP) ..... 2006-352661

(51) Int. Cl.
*A63B 53/04* (2006.01)

(52) U.S. Cl. ..... 473/335; 473/341; 473/345; 473/349

(58) Field of Classification Search ..... 473/324–350, 473/219–256, 282–292, 313–314; D21/736–746
See application file for complete search history.

(56) References Cited

U.S. PATENT DOCUMENTS

D216,030 S * 11/1969 Wigley ..... D21/733
5,482,281 A * 1/1996 Anderson ..... 473/313
5,769,736 A * 6/1998 Sato ..... 473/335
5,935,020 A * 8/1999 Stites et al. ..... 473/345
6,074,310 A * 6/2000 Ota ..... 473/345
6,152,833 A * 11/2000 Werner et al. ..... 473/324
6,478,692 B2 * 11/2002 Kosmatka ..... 473/342
6,716,110 B1 * 4/2004 Ballow ..... 473/242
6,716,114 B2 * 4/2004 Nishio ..... 473/314
6,855,068 B2 * 2/2005 Antonious ..... 473/327
6,929,559 B1 * 8/2005 Grace ..... 473/251
6,942,581 B2 * 9/2005 Kim et al. ..... 473/345
6,988,956 B2 * 1/2006 Cover et al. ..... 473/244
7,166,038 B2 * 1/2007 Williams et al. ..... 473/329
7,175,537 B2 * 2/2007 Pollman ..... 473/203
7,438,648 B2 * 10/2008 Wahl et al. ..... 473/340
2008/0153623 A1 * 6/2008 Ines ..... 473/340

* cited by examiner

*Primary Examiner*—Sebastiano Passaniti
(74) *Attorney, Agent, or Firm*—Birch, Stewart, Kollasch & Birch LLP

(57) ABSTRACT

A golf club head having a hollow structure including a club face having a toe-side extreme end and a heel-side extreme end between which a club face maximum width Wf is defined; and a rear part being rear of the club face and having a toe-side extreme end and a heel-side extreme end (excepting a hosel portion) between which a head maximum width Wh is defined, wherein a ratio (Wh/Wf) of the head maximum width Wh to the club face maximum width Wf is more than 1.0, but not more than 1.5 and the distance of the toe-side extreme end of the rear part and the distance of the heel-side extreme end of the rear part are not more than 0.2 times the distance of a front-side extreme end of the head, each distance measured in the back-and-forth direction of the head from a rear-side extreme end of the head, whereby the weight is distributed toward the toe, heel and rear of the head, and the depth of the center of gravity and the moment of inertia can be increased.

19 Claims, 9 Drawing Sheets e 1 section

GOLF CLUB HEAD

BACKGROUND OF THE INVENTION

The present invention relates to a golf club head, more particularly to a hollow structure having a specific shape capable of increasing the depth of center of gravity and the moment of inertia of the head.

It is effectual for improving the directionality of a hit ball to deepen the center of gravity of the head and to increase the moment of inertia. By increasing the depth of the center of gravity, the club face is increased in the sweet spot area and as a result the average carry distance can be increased. By increasing the moment of inertia, movements of the head caused by the counter-reaction to hitting of a ball is decreased, and the directionality can be improved.

Conventionally, driver or wood golf clubs have pear-shaped heads as shown in FIG. 10. Nowadays, in order to increase the moment of inertia and to deepen the center of gravity, very large-sized metal wood heads and metal/FRP hybrid wood heads are marketed. Even in such large-sized current heads, the shapes are pear-shapes, following a tradition.

In the case of pear-shaped heads, when obtaining a deep center of gravity and an increased moment of inertia, a certain degree of increase of the head volume and a certain degree of increase of the head weight are inevitable. As a result, the head speed during swing tends to decrease. As the head volume increases, a weight margin available for adjusting the position of the center of gravity is decreased, therefore, the flexibility of designing the weight distribution is lost. As a result, it becomes difficult to increase the depth of the center of gravity.

SUMMARY OF THE INVENTION

It is therefore, an object of the present invention to provide a golf club head having a specific shape different from the conventional pear-shapes and capable of increasing the depth of center of gravity and the moment of inertia of the head to thereby improve the directionality of the hit ball and the carry distance.

According to the present invention, a golf club head has a hollow structure comprising:

a club face having a toe-side extreme end and a heel-side extreme end between which a club face maximum width Wf is defined; and a rear part being rear of the club face and having a toe-side extreme end and a heel-side extreme end (excepting a hosel portion) between which a head maximum width Wh is defined, wherein the ratio (Wh/Wf) of the head maximum width Wh to the club face maximum width Wf is more than 1.0, but not more than 1.5, the toe-side extreme end of the club face is located on the heel-side of the toe-side extreme end of the rear part, and the heel-side extreme end of the club face is located on the toe-side of the heel-side extreme end of the rear part, and a distance of the toe-side extreme end of the rear part and a distance of the heel-side extreme end of the rear part are not more than 0.2 times a distance of a front-side extreme end of the head, each distance measured in the back-and-forth direction of the head from a rear-side extreme end of the head.

Therefore, the weight is distributed toward the toe, heel and rear of the head, and accordingly, the depth of the center of gravity and the moment of inertia can be increased.

In this description, the sizes, positions and the like of the head refer to those under the standard state of the head unless otherwise noted.

The standard state of the head 1 is such that the head is set on a horizontal plane HP so that the axis of the clubshaft(not shown) is inclined at the lie angle alpha while keeping the axis on a vertical plane VP, and the club face 2 forms its loft angle beta with respect to the horizontal plane HP. Incidentally, in the case of the head alone, the center line of the shaft inserting hole 7*a* can be used instead of the axis of the clubshaft.

The moment of inertia is the lateral moment of inertia around a vertical axis passing through the center G of gravity under the standard state.

The sweet spot S is the point of intersection between the club face 2 and a straight line N drawn normally to the club face 2 from the center G of gravity.

The back-and-forth direction FB is a direction parallel with the straight line N projected on the horizontal plane HP.

The heel-and-toe direction TH is a direction parallel with the horizontal plane HP and perpendicular to the back-and-forth direction.

The depth of the center G of gravity is the distance Lg between the sweet spot S and the center G of gravity.

The height T of the club face 2 is the distance in the up-and-down direction measured on the vertical plane including the sweet spot S between the upper edge 2*a* and lower edge 2*b* of the club face 2.

The maximum width Wf of the club face is the distance in the heel-and-toe direction measured between the toe-side extreme end point 2*t* and the heel-side extreme end point 2*h* of the club face 2.

The maximum length L of the head is the distance in the back-and-forth direction FB between the rear-side extreme end P and the front-side extreme end F of the head.

To reword, the maximum width Wh of the head is the distance in the heel-and-toe direction TH measured between the toe-side extreme end 1*t* of a rear part of the head being rear of the club face 2, and the heel-side extreme end 1*h* of the rear part excepting the hosel portion which may be protrude beyond the end 1*h*.

If the edge (2*a*, 2*b*, 2*c* and 2*d*) of the club face 2 is unclear due to smooth change in the curvature, a virtual edge line 2E which is defined, based on the curvature change is used instead as follows. As shown in FIGS. 11(*a*) and 11(*b*), in each cutting plane e1, e2, e3 - - - including the straight line N extending between the sweet spot S and the center G of gravity of the head, a point at which the radius (r) of curvature of the profile line (f) of the face portion first becomes under 200 mm in the course from the center S to the periphery of the club face is determined. Then, the virtual edge line is defined as a locus of the obtained points.

DESCRIPTION OF THE PREFERRED EMBODIMENTS

Figure 1:
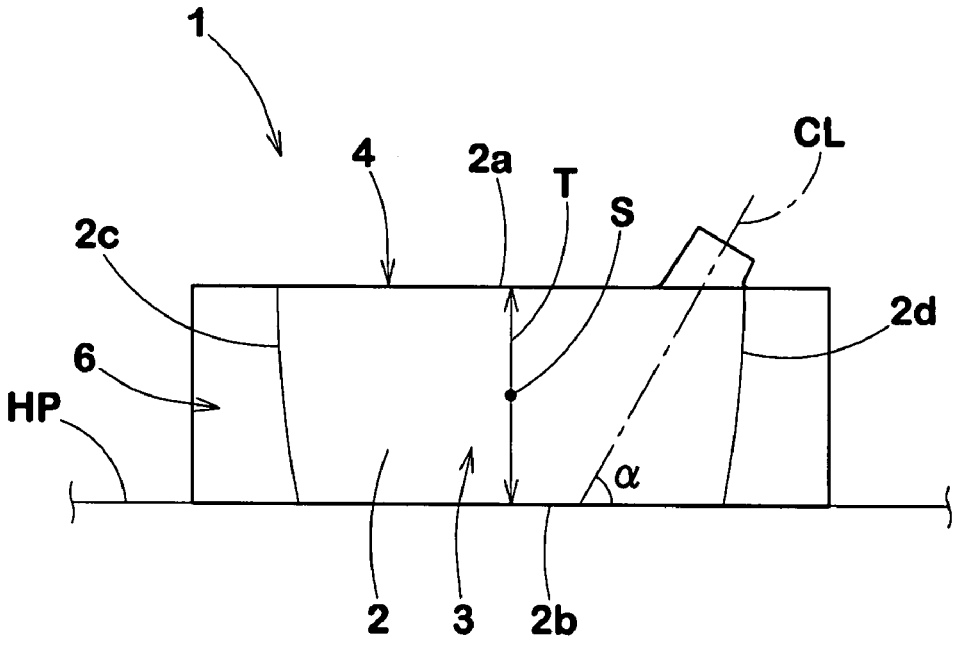
FIG. 1 is a front view of a golf club head according to the present invention.
Figure 2:
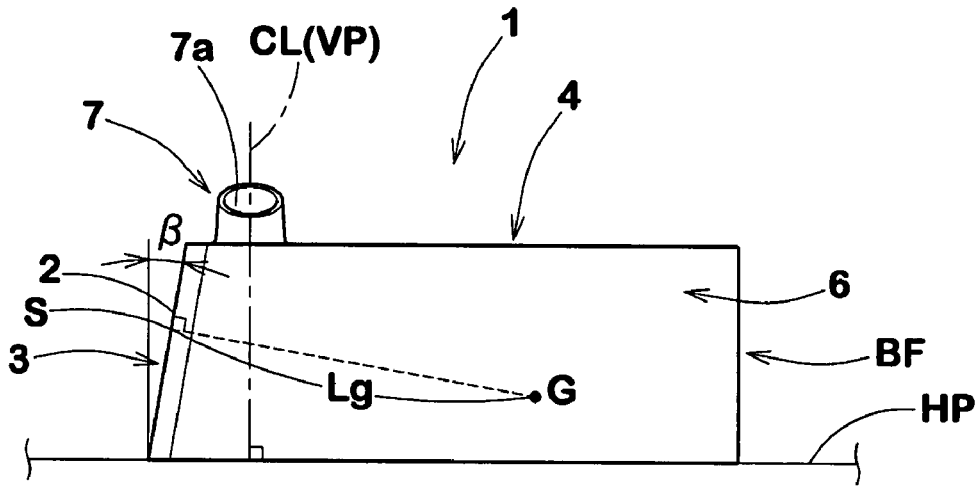
FIG. 2 is a right side view thereof.

In the drawings, golf club head 1 according to the present invention comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the head; and a hosel portion 7 at the heel side end of the crown to be attached to an end of a club shaft (not shown) inserted into the shaft inserting hole 7*a*. Thus, the head 1 is provided with a hollow structure with the thin wall. The hollow (i) in this example is a closed void space, but it may be filled with a foamed plastic, leaving a space from the backside of the face portion 3.

The golf club head 1 in this example is made up of two metal components: an open-front hollow main component 1A and a face component 1B closing the opening O of the main component 1A. It is of course possible that the head is made up of three or more components.

In order to increase the head volume without increasing the head weight, the specific gravity of the main component 1A is preferably in a range of not more than 4.6, more preferably not more than 4.0, still more preferably not more than 3.0, but not less than 1.0 in view of the strength and durability.

In order to reduce the weight of the face portion while maintaining the sufficient strength, the specific gravity of the face component 1B is preferably in a range of not less than 2.0, more preferably not less than 3.0, still more preferably not less than 4.0, but, not more than 6.0, more preferably not more than 5.5, still more preferably not more than 5.0.

For examples, titanium, titanium alloys, stainless steel alloys, maraging steels, magnesium alloys, aluminum alloys and the like can be used as the materials of the main component 1A and face component 1B. Such components are formed by forging, casting, press molding and the like, and connected with each other by welding and the like. Incidentally, fiber reinforced resins may be used, for example as a part of the main component 1A.

In the case that the head 1 is for a driver, the head volume is preferably set in a range of not less than 350 cc, more preferably not less than 400 cc, still more preferably not less than 450 cc to increase the depth of the center of gravity and the moment of inertia of the head. However, to prevent an excessive increase in the head weight and deteriorations of swing balance and durability and further in view of golf rules or regulations, the head volume is set in a range of not more than 460 cc.

The weight of the head 1 is preferably set in a range of not less than 170 grams, more preferably not less than 177 grams, still more preferably not less than 184 grams in view of the swing balance and rebound performance, but not more than 220 grams, more preferably not more than 210 grams in view of the directionality and traveling distance of the ball.

If the head is too small in the back-and-forth direction FB, the depth of the center G of gravity becomes shallow. If too large, it becomes difficult to conform to the golf rules or regulations. Therefore, the maximum length L of the head in the back-and-forth direction FB is set in a range of not less than 80 mm, preferably not less than 90 mm, more preferably not less than 100 mm, but not more than 122 mm, preferably not more than 120 mm, more preferably not more than 115 mm.

If the height T of the club face 2 is too small, the carry distance and directionality of the hit ball are liable to become unstable. If the height T is too large, as the head volume can not be too large, the maximum length L of the head tends to become small and as a result, it becomes difficult to increase the depth of the center of gravity. Therefore, the height T of the club face 2 is preferably set in a range of not less than 35 mm, more preferably not less than 38 mm, still more preferably not less than 40 mm, but not more than 55 mm, more preferably not more than 50 mm, still more preferably not more than 48 mm.

If the maximum width Wf of the club face is too small, the carry distance and directionality of the hit ball are liable to become unstable. If the maximum width Wf is too large, it becomes difficult to secure the necessary club face height T. Therefore, the maximum width Wf of the club face is preferably set in a range of not less than 80 mm, more preferably not less than 90 mm, still more preferably not less than 100 mm, but, not more than 120 mm, more preferably not more than 115 mm, still more preferably not more than 110 mm.

Figure 3:
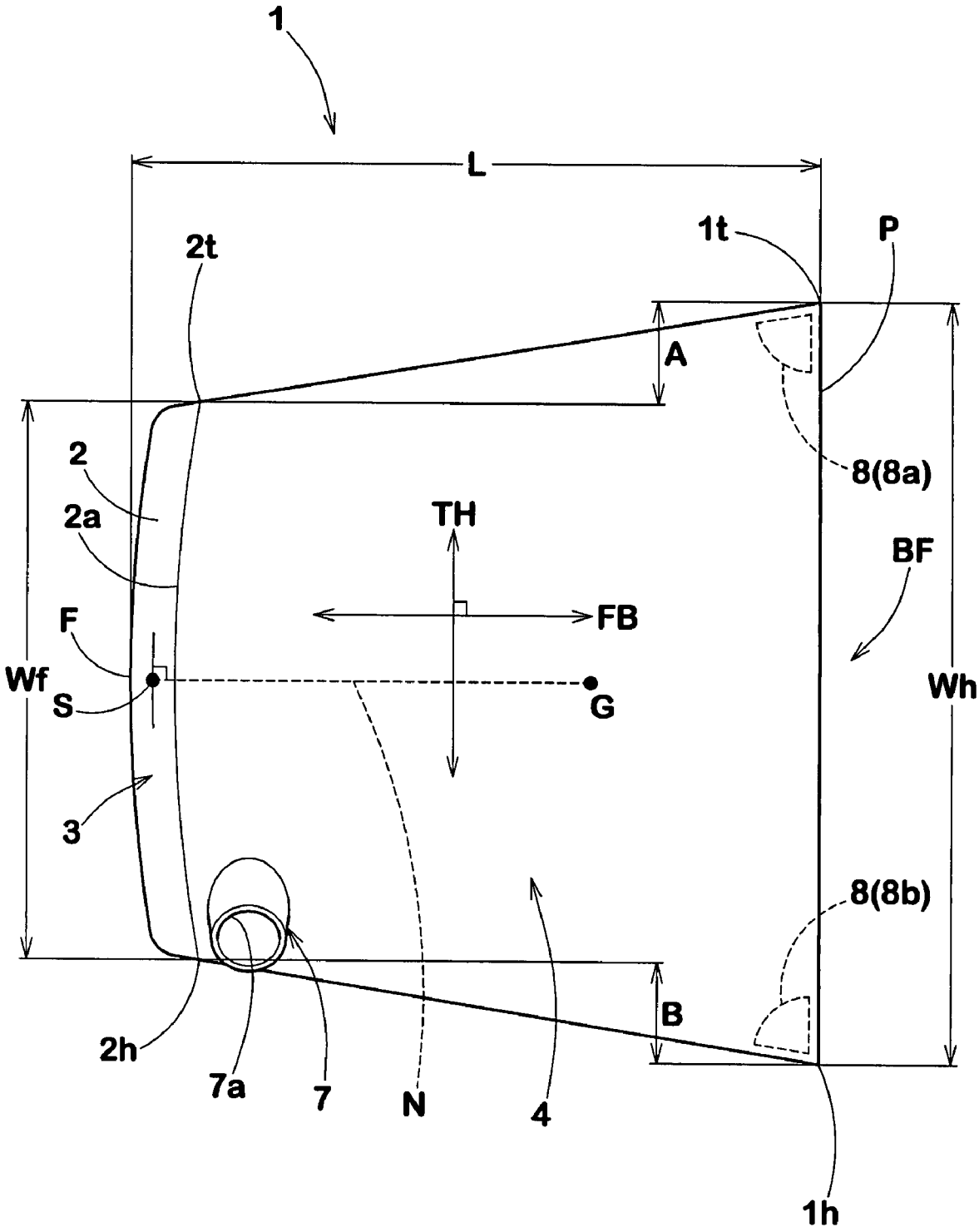
FIG. 3 is a top view thereof.
Figure 6:
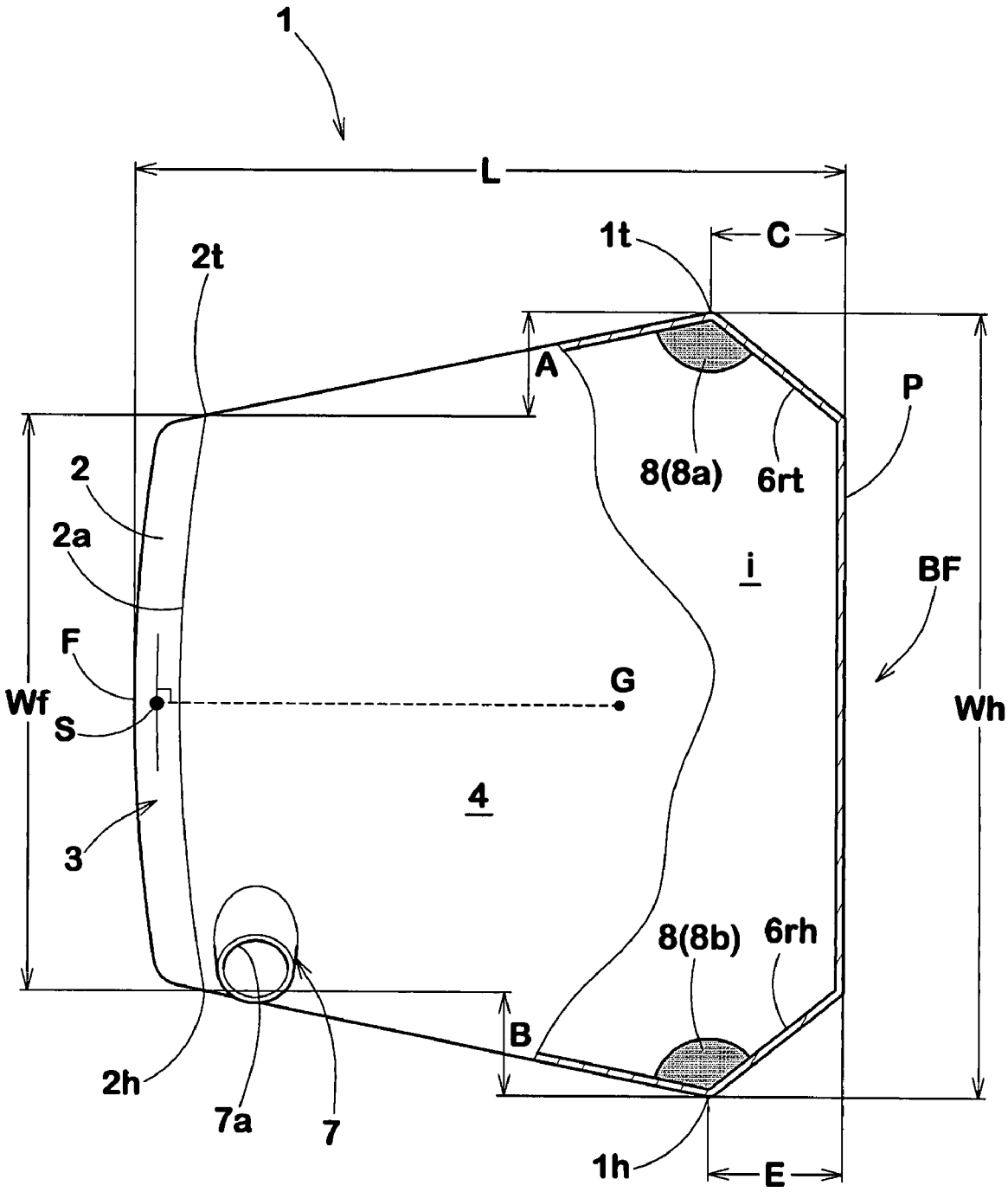
FIG. 6 is a top view of another example of the golf club head according to the present invention.
Figure 7:
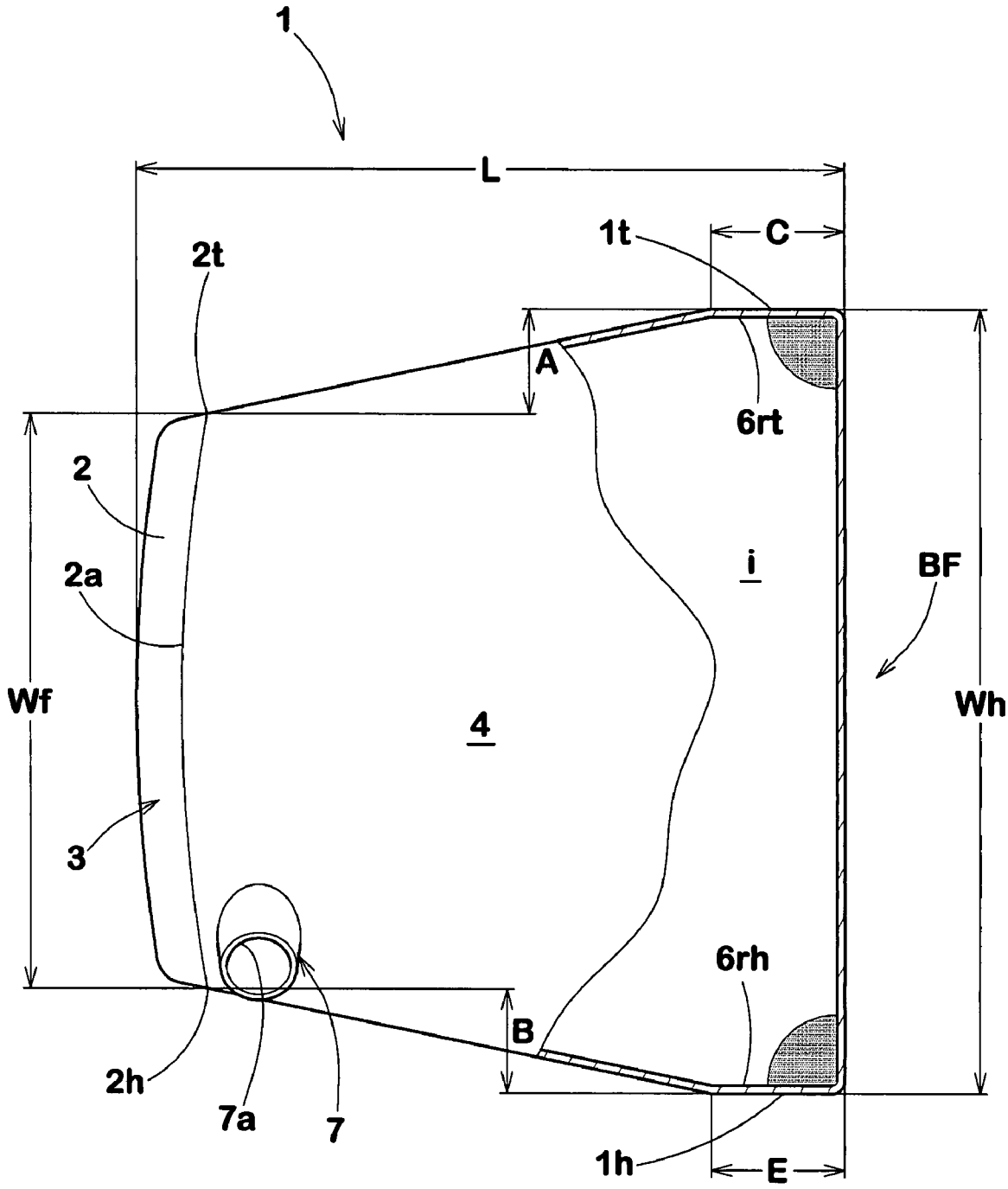
FIG. 7 is a top view of another example of the golf club head according to the present invention.

In the plan view of the head, namely, when viewed from above the head, the width of the head measured in the heel-and-toe direction is gradually increased from the face portion towards the back face BF. This increase in the width can be regarded as a result of an increase occurring on the toe-side and an increase occurring on the heel-side, and as shown in FIGS. 3, 6 and 7, the maximum A of the increase occurring on the toe-side and the maximum B of the increase occurring on the heel-side are preferably set in a range of not less than 5 mm, more preferably not less than 10 mm, but, not more than 20 mm, more preferably not more than 15 mm. If the maximum increases A and B are less than 5 mm, it is difficult to increase the moment of inertia and the depth of the center of gravity of the head. If the maximum increases A and B are more than 20 mm, the shape of the head becomes extraordinary and it is difficult to use.

To be exact, the maximum increase A can be defined as the distance between the toe-side extreme end 2*t* of the club face 2 and the toe-side extreme end 1*t* of the rear part measured in the heel-and-toe direction. Also the maximum increase B is defined as the distance between the heel-side extreme end 2*h* of the club face 2 and the heel-side extreme end 1*h* of the rear part measured in the heel-and-toe direction. The rear part is a part of the head excluding the club face 2 and the upwardly protruding hosel portion 7.

In FIGS. 3, 6 and 7, the maximum increase A is substantially same as the maximum increase B. But, it is of course possible that they can be different values. For example, in order to shift the center G of gravity towards the toe, the maximum increase A can be larger than the maximum increase B. In order to shift the center G of gravity towards the heel, the maximum increase B can be larger than the maximum increase A.

If the maximum width Wh of the head between the toe-side extreme end 1*t* and the heel-side extreme end 1*h* is too small, then the moment of inertia and/or the depth of the center of gravity can not be increased. If the maximum width Wh is too large, the club face 2 is sometimes obliged to decrease its height T and it becomes difficult to hit a ball at the sweet spot. Therefore, the head maximum width Wh is preferably set in a range of not less than 80 mm, more preferably not less than 90 mm, still more preferably not less than 100 mm, but, not more than 127 mm, more preferably not more than 122 mm, still more preferably not more than 115 mm. Further, the maximum width Wh is not less than the maximum length L.

In FIG. 3, the toe-side extreme end 1*t* and heel-side extreme end 1*h* are both located at the same position in the back-and-forth direction FB as the rear-side extreme end P of the head. And, in the plan view, the back face BF extends from the toe-side extreme end 1*t* to heel-side extreme end 1*h* in substantially parallel with the heel-and-toe direction. However, the toe-side extreme end 1*t* and heel-side extreme end 1*h* can be located in front of the rear-side extreme end P as far as the distance of the ends 1*t* and 1*h* from the end P is small. More specifically, the distance (c) of the toe-side extreme end 1*t* and the distance (E) of the heel-side extreme end 1*h*, each measured in the back-and-forth direction FB from the rear-side extreme end P of the head, are set in a range of not more than 0.2 times, preferably not more than 0.1 times the maximum length L of the head 1. As to the absolute values, the distances C and E are preferably not more than 25 mm, more preferably not more than 15 mm, still more preferably not more than 10 mm.

In FIG. 3, the distance (C) and distance (E) are zero.

In FIG. 6, the distance (C) and distance (E) are more than zero. Thus, the toe-side extreme end 1*t* and heel-side extreme end 1*h* are located in front of the rear-side extreme end P. In the plan view, the rear-side extreme end P (hereinafter, the "rear end part P") has a relatively large width being almost same as the maximum width Wf of the club face and being substantially parallel with the heel-and-toe direction. And the part 6*rt* between the heel-side end of the rear end part P and the above-mentioned heel-side extreme end 1*h* is inclined at about 45 degrees with respect to the heel-and toe direction. Also the part 6*rh* between the toe-side end of the rear end part P and the above-mentioned toe-side extreme end 1*t* is inclined at about 45 degrees with respect to the heel-and toe direction.

In FIG. 7 showing a modification of the FIG. 6 example, these parts 6*rt* and 6*rt* are inclined at 90 degrees. In this manner, the above-mentioned toe-side extreme end 1*t* and heel-side extreme end 1*h* may have a certain extent in the back-and-forth direction. The parts 6*rt* and 6*rt* may be inclined at an angle in a range of about 90 degrees to about 35 degrees.

The distances C and E may be different values. But, in the examples shown in FIGS. 3, 6 and 7, the distances C and E are substantially same values.

In the example shown in FIG. 3, the head is continuously increased in the width from the club face to the ends 1*t* and 1*h*. In the example shown in FIG. 6, the width of the head is continuously increased from the club face to the ends 1*t* and 1*h*, and then continuously decreased from the ends 1*t* and 1*h* to the end P. In the example shown in FIG. 7, the width of the head is continuously increased from the club face to the ends 1*t* and 1*h*, and then maintained at the constant value from the ends 1*t* and 1*h* to the end P. Thus, when viewed from above the head, the head 1 has a substantially trapezoidal shape, in particular isosceles trapezoidal shape.

In any case, if the maximum width Wh of the head is not more than 1.0 times the maximum width Wf of the club face, the moment of inertia can not be fully increased, therefore, the maximum width Wh is set in a range of more than 1.0 times, preferably not less than 1.1 times, more preferably not less than 1.2 times the maximum width Wf.

However, if the width Wh of the head is more than 1.5 times the maximum width Wf, then the maximum width Wh is unfavorably increased OR the height of the club face 2 is unfavorably decreased. As a result, the head is difficult to use. Therefore, the maximum width Wh is not more than 1.5 times, preferably not more than 1.4 times, more preferably not more than 1.3 times the maximum width Wf.

As explained above, the toe-side extreme end 2*t* is located on the heel-side of the toe-side extreme end 1*t*. The heel-side extreme end 2*h* is located on the toe-side of the heel-side extreme end 1*h*. Therefore, the weight is distributed far from the center G of gravity and the moment of inertia can be effectively increased.

Optionally, the head 1 is provided with a separate weighting member 8.

In this embodiment, a plurality of weighting members 8 are disposed which include a toe-side weighting member 8*a* disposed near the toe-side extreme end 1*t*, and a heel-side weighting member 8*b* disposed near the heel-side extreme end 1*h*.

The weighting member 8 is preferably made from a metal material whose specific gravity is larger than the main component 1A. For example, stainless steel alloys, tungsten, tungsten alloys, copper alloys, nickel alloys and the like can be used. Especially, tungsten-nickel alloys are preferred for the high specific gravity and antirust property.

The specific gravity of the weighting member 8 is preferably set in a range of not less than 10.0, more preferably not less than 11.0, still more preferably not less than 12.0, but, not more than 18.0, more preferably not more than 17.0, still more preferably not more than 16.0.

In order to increase the moment of inertia and the depth of center of gravity without a significant increase in the head weight, the total weight of the weighting member(s) 8 is preferably set in a range of not less than 6 grams, more preferably not less than 8 grams, still more preferably not less than 10 grams, but, not more than 40 grams, more preferably not more than 35 grams, still more preferably not more than 30 grams.

Therefore, the weighting members 8*a* and 8*b* can effectively increase the moment of inertia and the depth of the center of gravity and serve to improve the directionality of a hit ball.

The weighting member 8 may be disposed on the outer surface of the head. But, in the examples shown, the weighting members 8 are disposed in the hollow (i). In order to fix the weighting member 8 to the main component 1A, for examples, screw bolts, welding, adhesives and the like can be utilized alone or in combination. Further, it is also possible to shape the weighting member 8 itself like a screw bolt and screw it into a hole provided on the main component 1A.

In either case, the weighting member 8 is disposed near the extreme end 1*t*, 1*h* as mentioned above. Here, the term "near" means that the distance of the center Wg of gravity of the weighting member 8 from the extreme end 1*t*, 1*h* is not more than 0.2 times the head maximum width Wh when measured in the heel-and-toe direction, and not more than 0.2 times the head maximum length L when measured in the back-and-forth direction.

Figure 4:
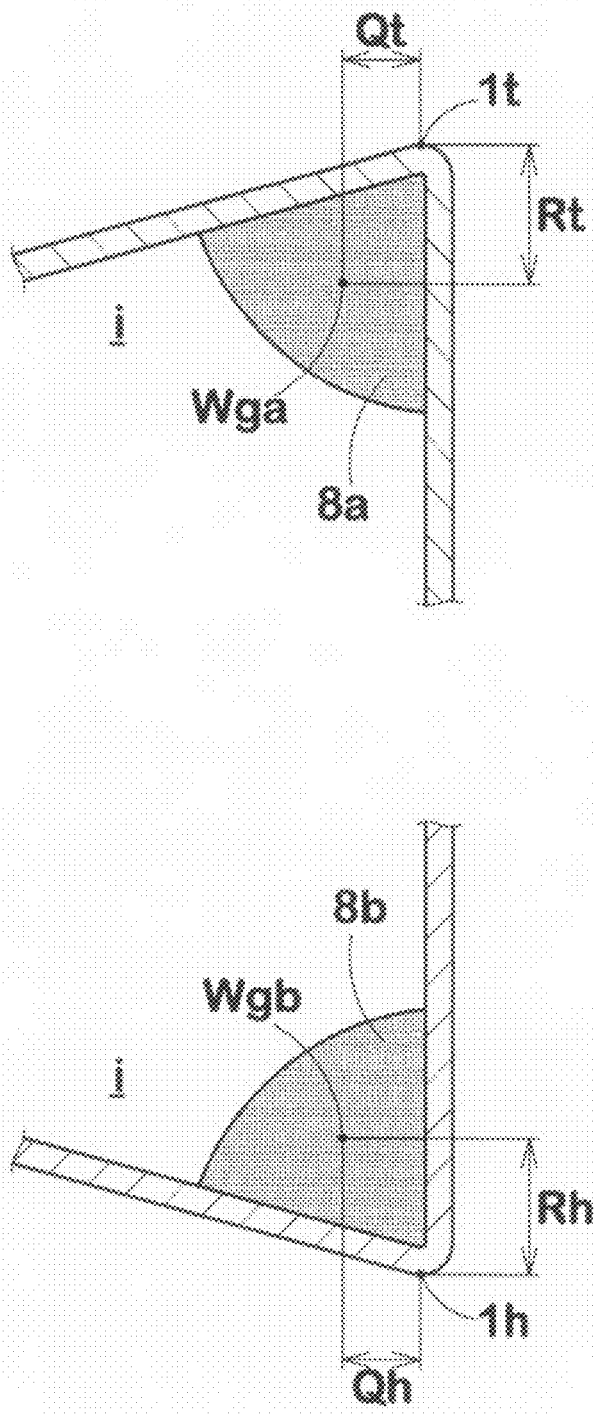
FIG. 4 is an enlarged partial cross sectional view showing weighting members attached to the inside of the head.
Figure 5:
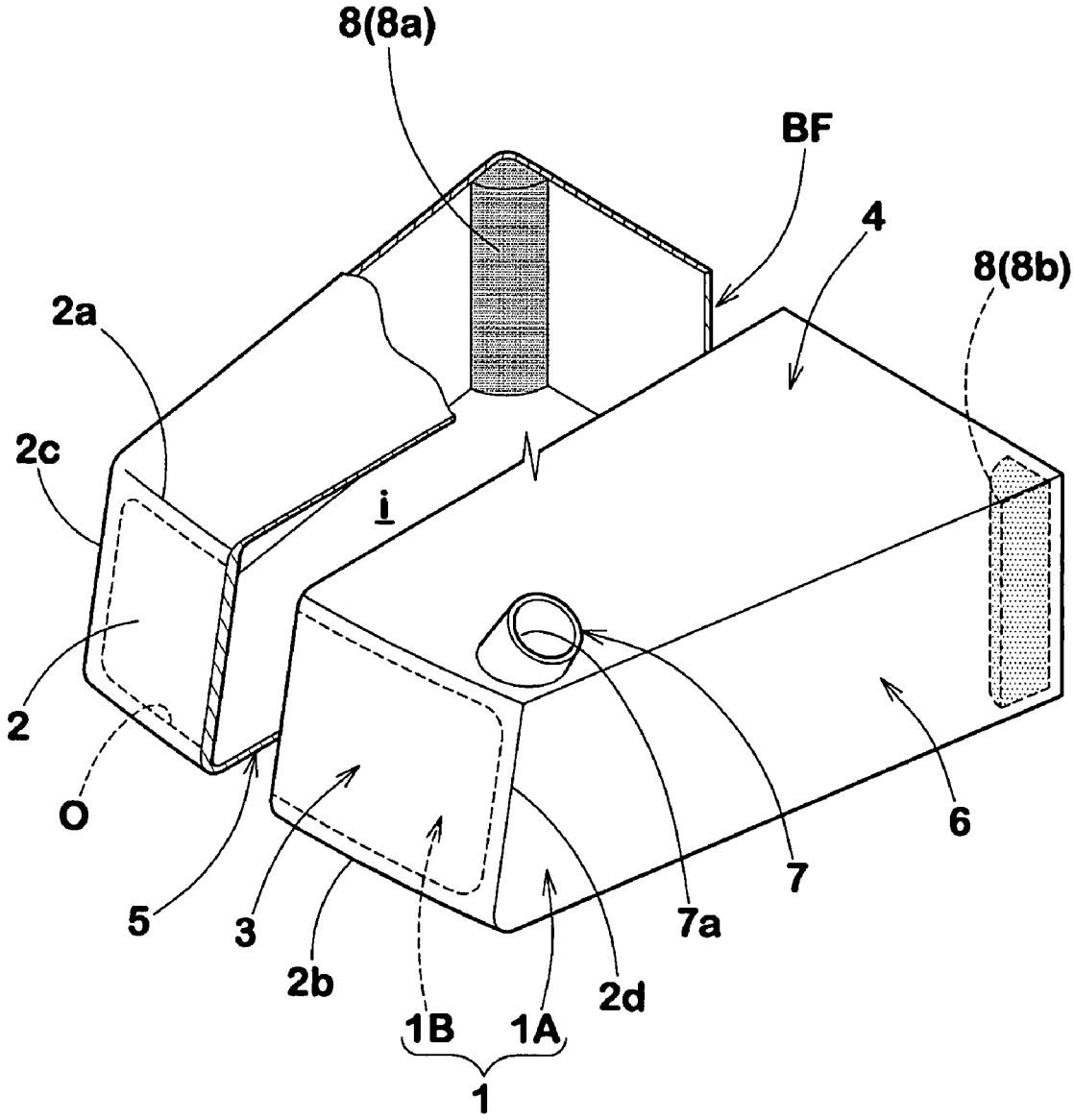
FIG. 5 is a perspective view of the head.

In the case of the head shown in FIG. 3, as shown in FIG. 4, in the plan view of the head, the distance Rt in the heel-and-toe direction between the center of gravity Wga of the toe-side weighting member 8*a* and the toe-side extreme end 1*t* is not more than 0.2 times the head maximum width Wh, and the distance Qt in the back-and-forth direction between the center of gravity Wga and the toe-side extreme end 1*t* is not more than 0.2 times the maximum length L of the head. Also, the distance Rh in the heel-and-toe direction between the center of gravity Wgb of the heel-side weighting member 8*b* and heel-side extreme end 1*h* is not more than 0.2 times the head maximum width Wh, and the distance Qh in the back-and-forth direction between the the center of gravity Wgb and the heel-side extreme end 1*h* is not more than 0.2 times the maximum length L of the head.

In the case of the head shown in FIG. 6, the distance Qt and distance Qh are substantially zero.

In the case of the head shown in FIG. 7, the extreme ends 1*t* and 1*h* each have a certain extent in the back-and-forth direction, and the center of gravity Wga and the center of gravity Wgb are disposed within the respective extents with respect to the back-and-forth direction. Therefor, the distance Qt and distance Qh can be said as zero.

In these examples, there is no separate weighting member other than the toe-side and heel-side weighting members 9*a* and 8*b*.

In order to widen the sweet spot area and to improve the carry distance and directionality, the depth Lg of the center of gravity is preferably set in a range of not less than 35 mm, more preferably not less than 38 mm, still more preferably not less than 40 mm. However, the depth Lg of the center of gravity is too large, there is a tendency that the strength of the front part of the head becomes insufficient. Therefore, the depth Lg of the center of gravity is preferably not more than 55 mm, more preferably not more than 53 mm, still more preferably not more than 50 mm.

In order to stabilize the head at impact and to improve the directionality of the hit ball, the moment of inertia of the head 1 is preferably set in a range of not less than 4000 (g sq.cm), more preferably not less than 4500 (g sq.cm), still more preferably not less than 5000 (g sq.cm), but not more than 6000 (g sq.cm) to comply with the golf rules or regulations.

In the above examples, the crown portion 4, sole portion 5, side portion 6 are formed to have substantially flat surfaces, but these portions can be formed to have curved surfaces or to have a curved surface and flat surface.

Comparison Tests

Golf heads (loft angle: 11 degrees, lie angle: 57 degrees) having specifications shown in Table 1 were prepared and attached to identical FRP shafts (SRI Sports Ltd. "MP200" flex R) to produce 45-inch drivers. Then the following comparison tests were conducted.

In each of the heads, the main component was formed by casting a titanium alloy Ti-6Al-4V. The face component was formed by press molding a plate of a titanium alloy Ti-4.5Al-3V-2Mo-2Fe. The weighting member made of a tungsten-nickel alloy having a specific gravity of 14.0 was fixed to the main component by Tig welding.

<Carry Distance and Directionality>

Each of five golfers having handicaps ranging from 10 to 25 hit golf balls ("XXIO" manufactured by SRI Sports Ltd.) ten times per each club, and the carry distances of the hit balls were measured. The mean value of the carry distances of each club is shown in Table 1 wherein the larger value is better. Further, to evaluate the directionality, the distance in the right-and-left direction between the landing point and the target line of the ball was measured. The mean value of the distances of each club is shown in Table 1, wherein the smaller value is better.

From the test results, it was confirmed that the heads according to the present invention can be increased in the depth of the center of gravity and the moment of inertia, therefore the carry distance and directionality can be improved.

TABLE 1

Figure 10:
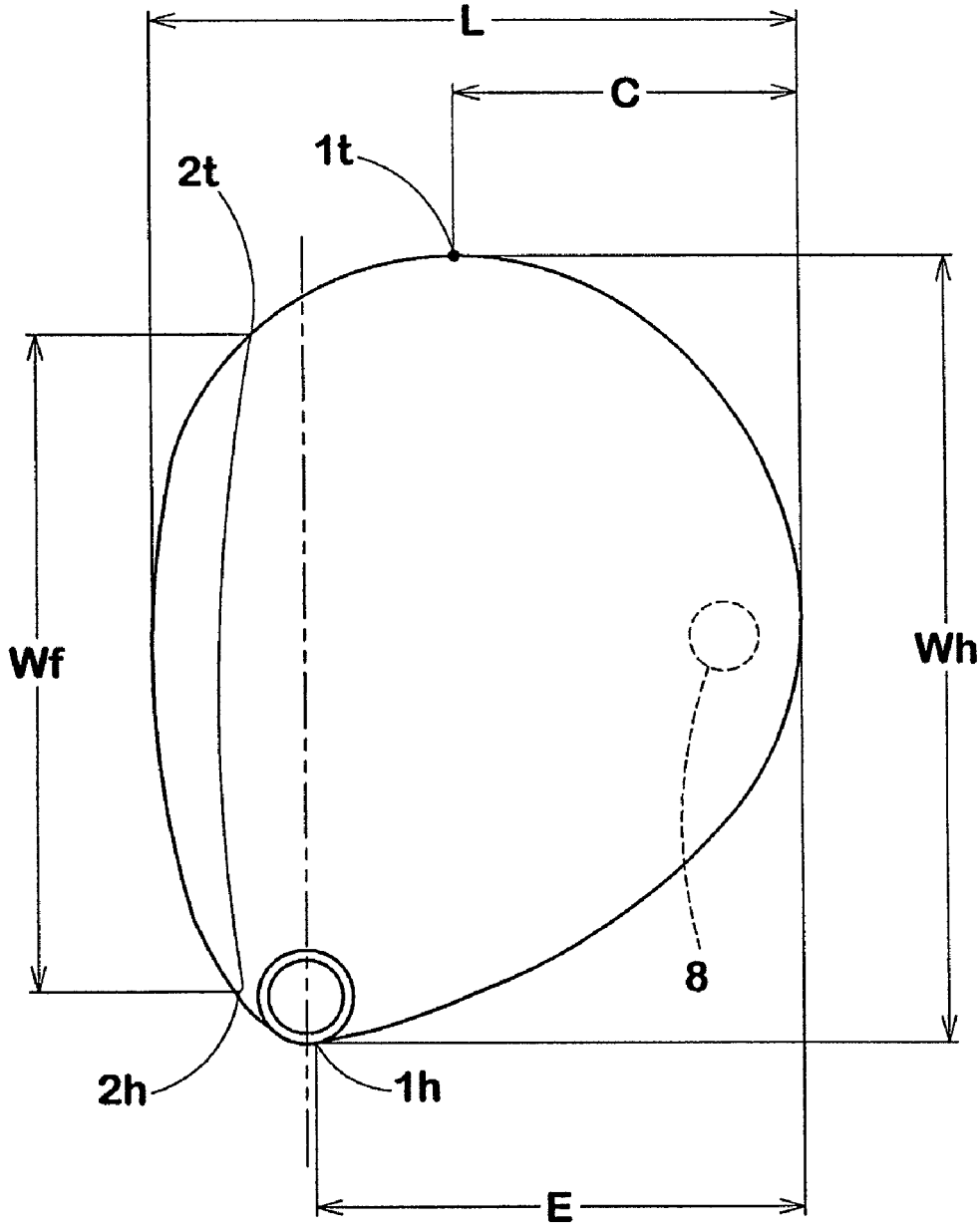
FIG.10 PRIOR ART
FIG. 10 is a top view of a conventional pear-shaped wood-type golf club head.
Figure 11A:
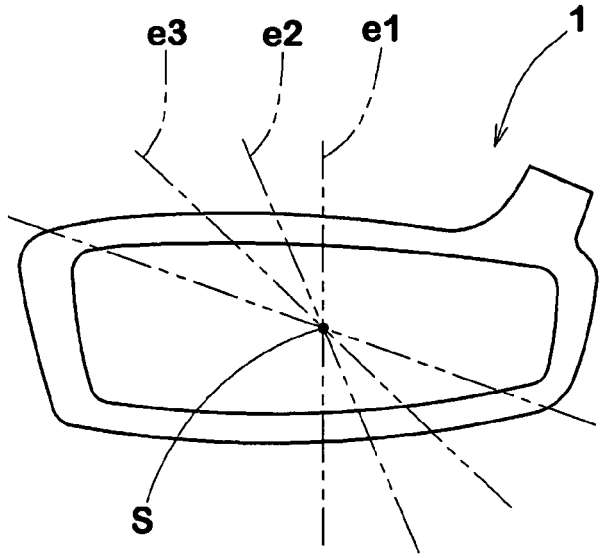
FIGS. 11(*a*) and 11(*b*) are diagrams for explaining the definition of the edge of a club face.
Figure 11B:
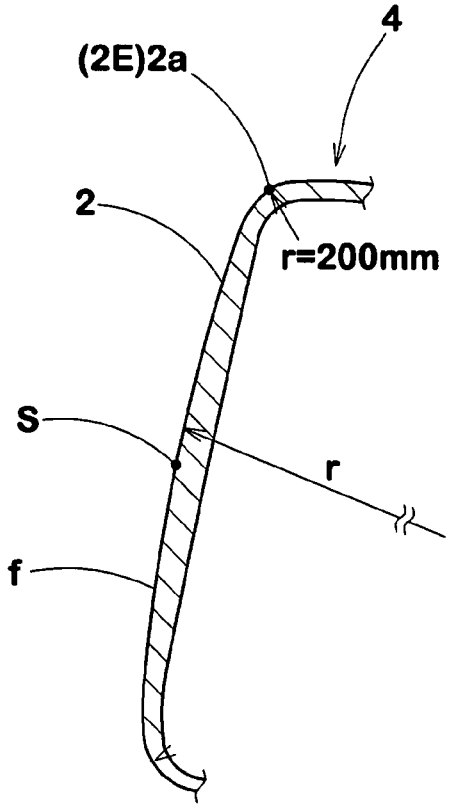

| Head | Ex. 1 | Ex. 2 | Ex. 3 | Ex. 4 | Ref. 1 | Ref. 2 |
|---|---|---|---|---|---|---|
| Shape | FIG. 3 | FIG. 6 | FIG. 3 | FIG. 3 | FIG. 10 | FIG. 10 |
| Head volume (cc) | 450 | 450 | 450 | 450 | 420 | 450 |
| Head weight (g) | 195 | 195 | 195 | 195 | 195 | 195 |
| Head width Wh (mm) | 120 | 120 | 105 | 114 | 116 | 120 |
| Face width Wf (mm) | 100 | 100 | 95 | 88 | 103 | 105 |
| Wh/Wf | 1.2 | 1.2 | 1.1 | 1.3 | 1.1 | 1.1 |
| Maximum widthwise increase | | | | | | |
| Toe-side A (mm) | 10 | 10 | 5 | 15 | 11 | 12 |
| Heel-side B (mm) | 10 | 10 | 5 | 15 | 3 | 3 |
| Maximum head length L (mm) | 100 | 100 | 100 | 100 | 98 | 100 |
| Distance C (mm) | 0 | 0 | 0 | 0 | 59 | 60 |
| C/L | 0.00 | 0.10 | 0.00 | 0.00 | 0.60 | 0.60 |
| Distance E (mm) | 0 | 0 | 0 | 0 | 88 | 90 |
| E/L | 0.00 | 0.10 | 0.00 | 0.00 | 0.90 | 0.90 |
| Face height H (mm) | 40.0 | 40.0 | 40.0 | 40.0 | 52.8 | 54.0 |
| Wall thickness (mm) | | | | | | |
| Face portion | 2.80 | 2.80 | 2.80 | 2.80 | 2.80 | 2.80 |
| Crown portion | 0.70 | 0.70 | 0.70 | 0.70 | 0.70 | 0.70 |
| Side portion | 0.80 | 0.80 | 0.80 | 0.80 | 0.80 | 0.80 |
| Sole portion | 0.80 | 0.80 | 0.80 | 0.80 | 0.80 | 0.80 |
| Specific gravity | | | | | | |
| Main component | 4.42 | 4.42 | 4.42 | 4.42 | 4.42 | 4.42 |
| Face component | 4.54 | 4.54 | 4.54 | 4.54 | 4.54 | 4.54 |
| Weighting member | 14.0 | 14.0 | 14.0 | 14.0 | 14.0 | 14.0 |
| Weighting member Weight (g) | | | | | | |
| Toe-side | 5 | 5 | 5.5 | 4.5 | — | — |
| Heel-side | 6 | 6 | 6.5 | 5.5 | — | — |
| Rear-side | — | — | — | — | 18 | 15 |
| Distance Qt (mm) | 7 | 1 | 7.5 | 6.5 | — | — |
| Distance Rt (mm) | 7 | 7 | 7.5 | 6.5 | — | — |
| Distance Qh (mm) | 7 | 1 | 7.5 | 6.5 | — | — |
| Distance Rh (mm) | 7 | 7 | 7.5 | 6.5 | — | — |

TABLE 1-continued

Figure 8:
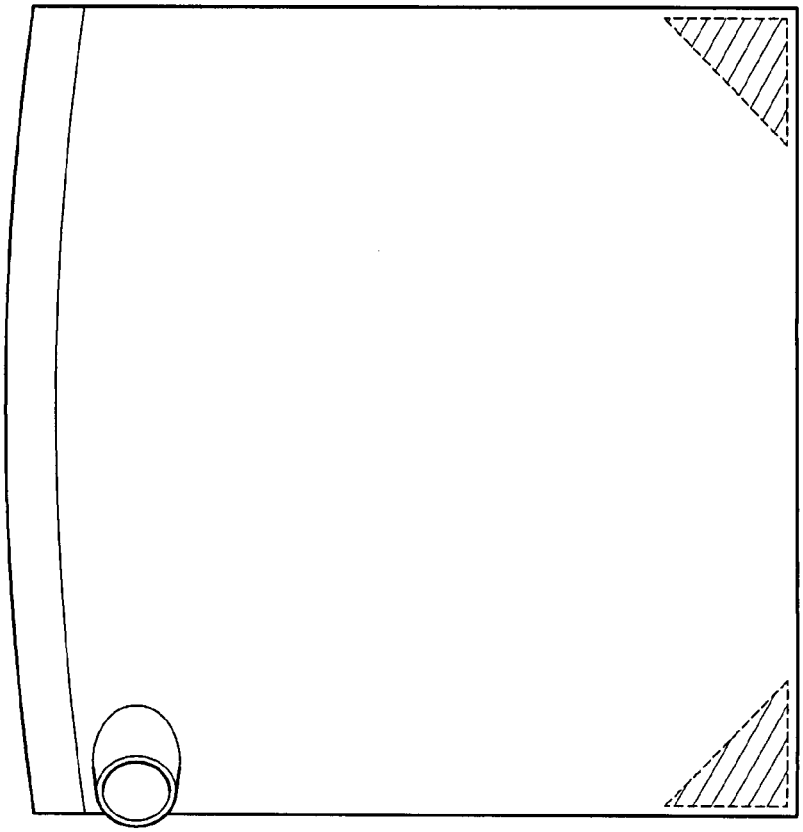
FIG. 8 and FIG. 9 are top views of golf club heads used in the undermentioned comparison tests.
Figure 9:
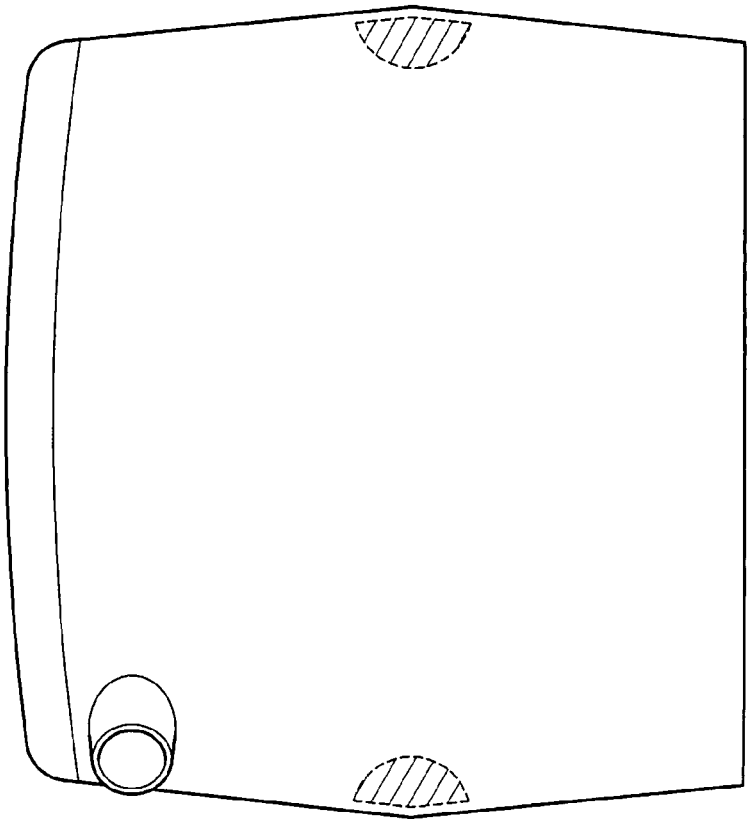

| | | | | | | | |
|---|---|---|---|---|---|---|---|
| Depth of center of gravity (mm) | 44 | 43.5 | 44 | 44 | 39 | 38 | |
| Moment of inertia (g sq. cm) | 5700 | 5650 | 5850 | 6000 | 4100 | 4300 | |
| Carry distance (m) | 215 | 213 | 218 | 220 | 199.8 | 200.9 | |
| Directionality (m) | 10 | 10.2 | 9.1 | 8 | 17.2 | 16.4 | |
| Head | Ref. 3 | Ref. 4 | Ref. 5 | Ref. 6 | Ref. 7 | Ex. 5 | Ex. 6 |
| Shape | FIG. 8 | FIG. 9 | FIG. 9 | FIG. 8 | FIG. 9 | FIG. 3 | FIG. 3 |
| Head volume (cc) | 450 | 450 | 450 | 450 | 450 | 450 | 450 |
| Head weight (g) | 195 | 195 | 195 | 195 | 195 | 195 | 195 |
| Head width Wh (mm) | 110 | 120 | 120 | 110 | 120 | 120 | 120 |
| Face width Wf (mm) | 110 | 110 | 100 | 110 | 110 | 100 | 100 |
| Wh/Wf | 1 | 1.2 | 1.2 | 1 | 1.2 | 1.2 | 1.2 |
| Maximum widthwise increase | | | | | | | |
| Toe-side A (mm) | 0 | 10 | 10 | 0 | 10 | 10 | 10 |
| Heel-side B (mm) | 0 | 10 | 10 | 0 | 10 | 10 | 10 |
| Maximum head length L (mm) | 100 | 100 | 100 | 100 | 100 | 100 | 100 |
| Distance C (mm) | — | 50 | 10 | — | 50 | 10 | 10 |
| C/L | — | 0.50 | 0.30 | — | 0.50 | 0.10 | 0.20 |
| Distance E (mm) | — | 50 | 10 | — | 50 | 10 | 10 |
| E/L | — | 0.50 | 0.30 | — | 0.50 | 0.10 | 0.20 |
| Face height H (mm) | 40.0 | 40.0 | 40.0 | 40.0 | 40.0 | 40.0 | 40.0 |
| Wall thickness (mm) | | | | | | | |
| Face portion | 2.80 | 2.80 | 2.80 | 2.80 | 2.80 | 2.80 | 2.80 |
| Crown portion | 0.70 | 0.70 | 0.70 | 0.70 | 0.70 | 0.70 | 0.70 |
| Side portion | 0.80 | 0.80 | 0.80 | 0.80 | 0.80 | 0.80 | 0.80 |
| Sole portion | 0.80 | 0.80 | 0.80 | 1.00 | 1.00 | 1.00 | 1.00 |
| Specific gravity | | | | | | | |
| Main component | 4.42 | 4.42 | 4.42 | 4.42 | 4.42 | 4.42 | 4.42 |
| Face component | 4.54 | 4.54 | 4.54 | 4.54 | 4.54 | 4.54 | 4.54 |
| Weighting member | 14.0 | 14.0 | 14.0 | — | — | — | — |
| Weighting member Weight (g) | | | | | | | |
| Toe-side | 6 | 5 | 5 | — | — | — | — |
| Heel-side | 7 | 6 | 6 | — | — | — | — |
| Rear-side | — | — | — | — | — | — | — |
| Distance Qt (mm) | 8 | 0 | 0 | — | — | — | — |
| Distance Rt (mm) | 8 | 7 | 7 | — | — | — | — |
| Distance Qh (mm) | 8 | 0 | 0 | — | — | — | — |
| Distance Rh (mm) | 8 | 7 | 7 | — | — | — | — |
| Depth of center of gravity (mm) | 44 | 42 | 42 | 37 | 36 | 40 | 39 |
| Moment of inertia (g sq. cm) | 5400 | 5200 | 5450 | 4700 | 4500 | 4900 | 4850 |
| Carry distance (m) | 208.9 | 206.5 | 209 | 202.4 | 201.5 | 205 | 204.2 |
| Directionality (m) | 12.1 | 13.2 | 12 | 15.2 | 15.8 | 13.9 | 14.2 |

The invention claimed is:

1. A golf club head having a hollow structure comprising:

a club face for striking a ball having a toe-side extreme end and a heel-side extreme end between which a club face maximum width Wf is defined; and a rear part being rear of the club face and having a toe-side extreme end and a heel-side extreme end between which a head maximum width Wh is defined; and a hosel portion to be attached to an end of a club shaft disposed on said rear part in vicinity to the club face on the heel-side, wherein the ratio (Wh/Wf) of the head maximum width Wh to the club face maximum width Wf is more than 1.0, but not more than 1.5, said toe-side extreme end of the club face is located on the heel-side of the toe-side extreme end of the rear part, and said heel-side extreme end of the club face is located on the toe-side of the heel-side extreme end of the rear part, and a distance of the toe-side extreme end of the rear part and a distance of the heel-side extreme end of the rear part are not more than 0.2 times a distance of a front-side extreme end of the head, each distance measured in the back-and-forth direction of the head from a rear-side extreme end of the head.

2. The golf club head according to claim 1, wherein said hollow structure has a substantially trapezoidal shape when viewed from above the head, and the width of said shape in the heel-and toe direction is gradually increased from the club face toward the rear-side extreme end of the head.

3. The golf club head according to claim 2, which further comprises a weighting member disposed near the toe-side extreme end of the rear part.

4. The golf club head according to claim 2, which further comprises a weighting member disposed near the heel-side extreme end of the rear part.

5. The golf club head according to claim 1, which further comprises a weighting member disposed near the toe-side extreme end of the rear part.

6. The golf club head according to claim 1, which further comprises a weighting member disposed near the heel-side extreme end of the rear part.

7. The golf club head of claim 1, wherein the golf club head is for a driver having a club face with a height of 35 to 55 mm.

8. The golf club head of claim 1, wherein the club face has a maximum width of 80 to 120 mm.

9. The golf club head of claim 1 comprising an open-front hollow main component having a specific gravity of 1.0 to 4.6 and a face component having a specific gravity of 2.0 to 6.0.

10. The golf club of claim 1, wherein the maximum increase in the width of the head, occuring on the toe-side and on the heel-side, respectively, is not less than 5 mm and not more than 20 mm.

11. The golf club of claim 10, wherein the increase in the width of the head occurring on the tow-side and on the heel-side are different values.

12. The golf club head of claim 1, wherein the depth of the center of gravity from a sweet spot on the club race is 35 to 55 mm.

13. The golf club head of claim 1, where the moment of inertia of the head is 4000 to 6000 g/cm$^2$.

14. A golf club head having a hollow structure comprising:

a club face for striking a ball having a toe-side extreme end and a heel-side extreme end between which a club face maximum width Wf is defined;

a rear part being rear of the club face and having a toe-wide extreme end and a heel-side extreme end between which a head maximum width Wh is defined; and a hosel portion to be attached to an end of a club shaft disposed on said rear part in vicinity to the club face on the heel-side, wherein the ratio (Wh/Wf) of the head maximum width Wh to the club face maximum width Wf is more than 1.0, but not more than 1.5, said toe-side extreme end of the club face is located on the heel-side of the toe-side extreme end of the rear part, and said heel-side extreme end of the club face is located on the toe-side of the heel-side extreme end of the rear part, a distance of the toe-side extreme end of the rear part and a distance of the heel-side extreme end of the rear part are not more than 0.2 times a distance of a front-side extreme end of the head, each distance measured in the back-and-forth direction of the head from a rear-side extreme end of the head, and the width of said shape in the heel-and-toe direction is gradually increased from the club face toward the rear-side extreme end of the head, whereby said hollow structure has a substantially trapezoidal shape when viewed from above the head, wherein said width is gradually increased to the toe-side extreme end and heel-side extreme end of the rear part, and then gradually decreased to the rear-side extreme end.

15. The golf club head according to claim 14, which further comprises a weighting member disposed near the toe-side extreme end of the rear part.

16. The golf club head according to claim 14, which further comprises a weighting member disposed near the heel-side extreme end of the rear part.

17. A golf club head having a hollow structure comprising:

a club face for striking a ball, having a toe-side extreme end and a heel-side extreme end between which a club face maximum width Wf is defined;

a rear part being rear of the club face and having a toe-side extreme end and a heel-side extreme end between which a head maximum width Wh is defined; and a hosel portion to be attached to an end of a club shaft disposed on said rear part in vicinity to the club face on the heel-side, wherein the ratio (Wh/Wf) of the head maximum width Wh to the club face maximum width Wf is more than 1.0, but not more than 1.5, said toe-side extreme end of the club face is located on the heel-side of the toe-side extreme end of the rear part, and said heel-side extreme end of the club face is located on the toe-side of the heel-side extreme end of the rear part, a distance of the toe-side extreme end of the rear part and a distance of the heel-side extreme end of the rear part are not more than 0.2 times a distance of a front-side extreme end of the head, each distance measured in the back-and-forth direction of the head from a rear-side extreme end of the head, and the width of said shape in the heel-and-toe direction is gradually increased from the club face toward the rear-side extreme end of the head, whereby said hollow structure has a substantially trapezoidal shape when viewed from above the head, wherein said width is gradually increased to the toe-side extreme end and heel-side extreme end of the rear part, which extreme ends each have a certain extent in the back-and-forth direction.

18. The golf club head according to claim 17, which further comprises a weighting member disposed near the toe-side extreme end of the rear part.

19. The golf club head according to claim 17, which further comprises a weighting member disposed near the heel-side extreme end of the rear part.

* * * * *